US005286949A

United States Patent [19]

Simons

[11] Patent Number: 5,286,949

[45] Date of Patent: Feb. 15, 1994

[54] APPARATUS AND METHOD FOR HEATING AND MOISTENING HAIR ROLLERS USING STEAM AND HAIR ROLLERS FOR USE THEREWITH

[76] Inventor: Rosemary Simons, 18 St. Andrews Rd., Arden, N.C. 28704

[21] Appl. No.: 777,129

[22] Filed: Oct. 16, 1991

[51] Int. Cl.[5] ..... H05B 1/02; H05B 6/80; A45D 4/10; A45D 7/02

[52] U.S. Cl. ..... 219/222; 99/440; 126/369; 132/200; 132/211; 132/226; 132/272; 219/688; 219/401; 219/439; 219/521; 220/507; 220/512; 220/525; 220/526

[58] Field of Search ..... 219/222-226, 219/401, 439, 521, 10.55 R, 10.55 E; 220/507, 528, 529, 345, 510, 512, 513, 525, 526; 99/440; 132/226-234, 237, 200, 210, 211, 271, 272; 126/369

[56] References Cited

U.S. PATENT DOCUMENTS

| | | | |
|---|---|---|---|
| 1,913,442 | 6/1933 | Hanks | 219/401 X |
| 2,138,908 | 12/1938 | Douthitt | 219/401 X |
| 2,622,187 | 12/1952 | Welch | 219/10.55 E |
| 3,347,618 | 10/1967 | McKeown | 219/439 X |
| 3,480,019 | 11/1969 | Popeil . | |
| 3,487,197 | 12/1969 | D'Elia et al. . | |
| 3,493,722 | 2/1970 | Popeil | 219/401 X |
| 3,495,583 | 2/1970 | Katzman | 219/401 X |
| 3,565,083 | 2/1971 | Popeil . | |
| 3,593,873 | 7/1971 | Vonk | 220/507 |
| 3,646,316 | 2/1972 | Volosin et al. . | |
| 3,654,428 | 4/1972 | Talge et al. | 219/401 X |
| 3,700,853 | 10/1972 | Jensen et al. | 132/229 X |
| 3,706,315 | 12/1972 | Johansen . | |
| 3,749,106 | 7/1973 | Kelmann et al. . | |
| 3,754,116 | 8/1973 | Godel | 132/229 X |
| 3,858,029 | 12/1974 | Walter . | |
| 4,084,080 | 4/1978 | McMahan | 126/369 X |
| 4,271,344 | 6/1981 | Horiuchi et al. | 219/10.55 E |
| 4,317,017 | 2/1982 | Bowen | 219/10.55 E |
| 4,413,167 | 11/1983 | Martel et al. | 219/10.55 E |
| 4,710,609 | 12/1987 | Switlicki | 219/10.55 E |
| 4,849,593 | 7/1989 | Hughes et al. | 219/10.55 R |
| 5,030,820 | 7/1991 | Gibbon | 219/222 X |

FOREIGN PATENT DOCUMENTS

| | | | |
|---|---|---|---|
| 558486 | 6/1958 | Canada | 219/401 |
| 25702 | of 1902 | United Kingdom | 99/440 |
| 1589261 | 5/1981 | United Kingdom | 219/401 |

*Primary Examiner*—Anthony Bartis
*Attorney, Agent, or Firm*—Sherman and Shalloway

[57] ABSTRACT

An apparatus and method for providing heated hair rollers wherein the rollers are suspended vertically in a heating chamber of a housing, an amount of water is introduced into the chamber and heated to generate steam which surrounds the rollers and condenses thereon heating and moistening the rollers which may then be removed and applied to a person's hair. The rollers are suspended by a horizontal plate within the housing which defines a steam chamber between the plate and the bottom of the housing. The plate has a plurality of holes sized to allow passage of the rollers. Each hair roller has a head portion which is larger in diameter than the respective hole whereby the rollers are suspended from the plate within the steam chamber such that the head portion of each roller remains outside of the heating chamber to provide a relatively cool handle for easy manipulation of the heated and moistened rollers. Heating may be achieved by an electric heater in the housing but it is preferred that the apparatus be constructed out of microwave transparent materials and that heating of the water be carried out by placing the apparatus in an operating microwave oven.

19 Claims, 5 Drawing Sheets

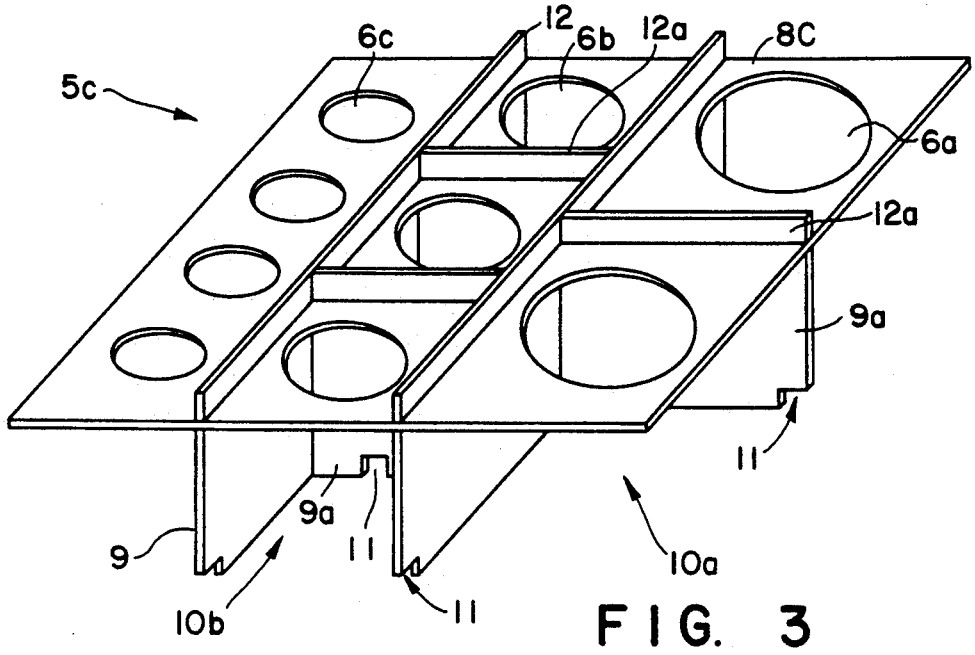
FIG. 3
FIG. 7
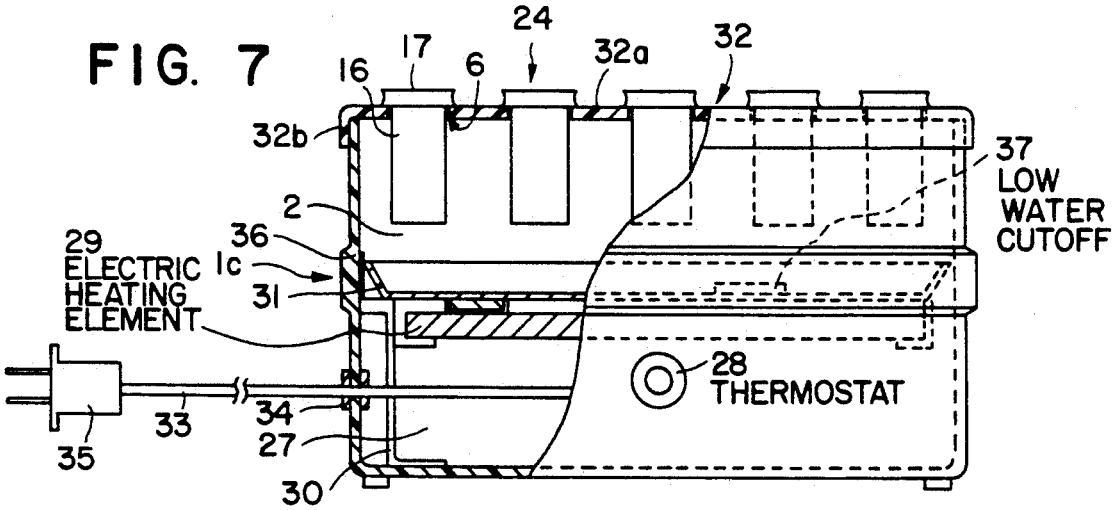
FIG. 8
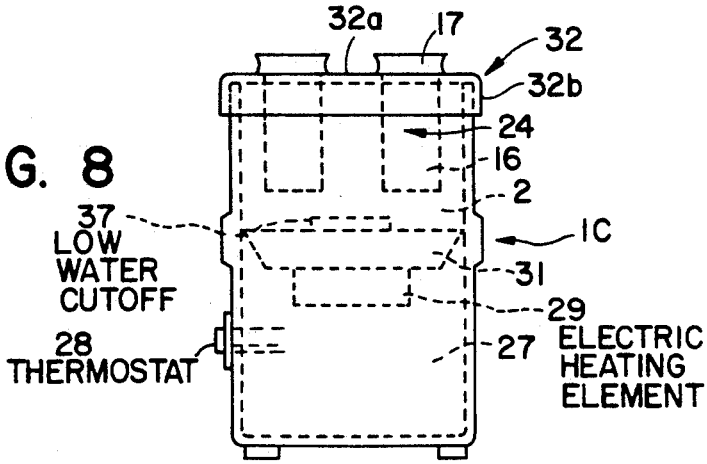

FIG. 4
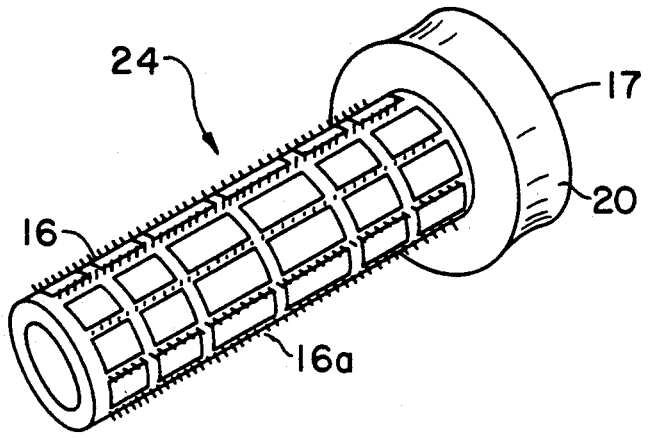
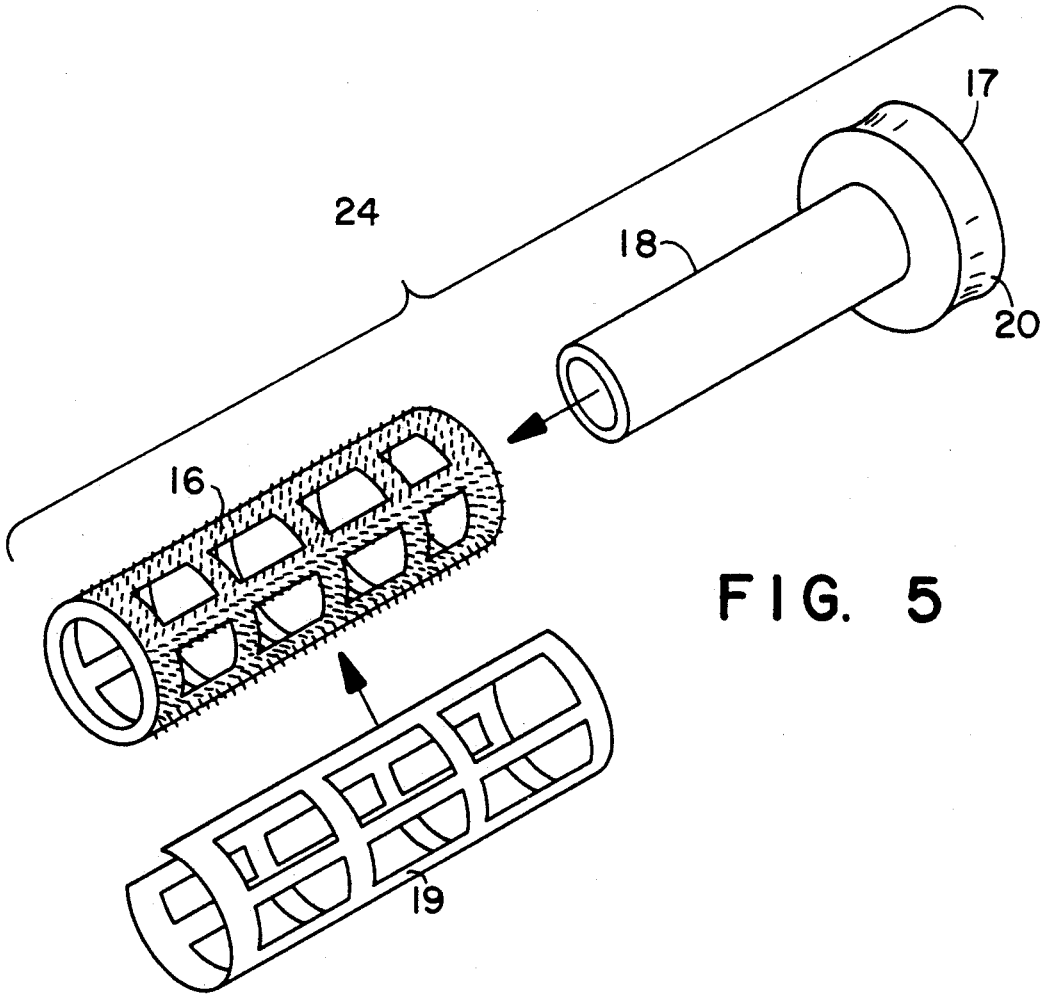
FIG. 5

APPARATUS AND METHOD FOR HEATING AND MOISTENING HAIR ROLLERS USING STEAM AND HAIR ROLLERS FOR USE THEREWITH

FIELD OF THE INVENTION

The present invention is directed toward an apparatus and method for use in curling a person's hair wherein rollers may be heated and moistened in a safe and easy manner. The invention also presents an apparatus that permits the use of light weight rollers which may be heated and moistened inside and out by steam prior to placing in a person's hair thereby eliminating the excessive weight encountered in prior heated rollers. Furthermore, means are provided whereby the heated rollers may be safely handled without burning one's fingers and whereby the rollers may retain their high heat and moisture until use.

SUMMARY OF THE INVENTION

An apparatus and method for providing heated hair rollers wherein rollers are suspended in a heating chamber of a housing in which an amount of water or other liquid is introduced and the assembly is exposed to microwave energy for a period of time sufficient to cause the water to boil and generate steam whereby the rollers are heated and moistened and may then be removed from the housing and applied to a person's hair where the high heat and moisture serve to impart a set to the hair. The rollers are lightweight and are heated by steam in such a manner that heat is applied to the interior and exterior surfaces thereof. A portion of the roller forming a graspable head is maintained outside of the heating chamber and is, therefore, cooler to the touch.

BACKGROUND OF THE INVENTION

The present invention provides a hair curling system wherein hair rollers are heatable by the circulating action of steam within an enclosed chamber so as to provide moist heat for curling and setting one's hair. The apparatus preferably comprises a housing having a heating chamber within which the rollers are suspended and side compartments for holding roller clips and the like. Within the heating chamber is a removable roller support plate which supports the rollers within the housing. This plate may also have dividers to separate groups of rollers. A slidable lid is provided so that only a select number of rollers are exposed at a time. Moist heat is provided to the rollers by means of steam generated from water or other liquids introduced into the heating chamber and caused to boil by the application of microwave energy from a standard home microwave oven or by an electric heating element. The housing also functions as a storage caddy for the rollers and clips.

Heretofore, most commercially available hair curling systems using a plurality of rollers have been heated by placing the various size rollers on metal posts in a housing and directly heating the posts by electric current, for example, the Clairol units as represented by U.S. Pat. No. 3,858,029 to Walter. The rollers usually include heat retention means which may be a metal sleeve or core or an oil filled space which adds weight to each roller. In addition, the heat is applied to the entire roller, including the ends, which makes them difficult to handle.

A further drawback to these prior systems is that the heat is a dry heat which is damaging to the hair. Attempts to apply moisture or steam to the outside of these rollers have involved the combination of the above mentioned heating posts with steam generation as in Walter, U.S. Pat. No. 3,858,029, or enclosed drawers containing the rollers and confining them within a steam chamber as in Volosin, et al., U.S. Pat. No. 3,646,316. Another method of providing heated and moistened rollers involves heating the rollers in a pan of hot or boiling water as shown in U.S. Pat. No. 3,480,019 to Popeil. The difficulties and dangers involved in handling the thus heated rollers, particularly in their removal from the hot water, are obvious.

The present invention allows one to quickly, comfortably and safely curl dry hair using heated moistened rollers. Because moisture is transferred to the hair simultaneously while heating, the natural moisture and oils of the hair are not removed. In contrast, dry setting with electrically heated rollers and irons evaporates this natural moisture leaving the hair dull, lifeless and often with split ends. Permanently waved, colored or bleached hair becomes very drab and brittle with the hot-dry set method and requires frequent conditioning. The apparatus and method presented herein also provides speed and convenience as well as increased comfort since the rollers are lighter in weight than prior conventional electrically heated rollers and, even after heating, have a head portion which is relatively cool to the touch. The rollers are therefor easier to wind and clamp. Furthermore, heating a full set of rollers in a microwave oven, as is preferred in the primary embodiment, is faster than the prior methods and the design of the apparatus is such that heat and moisture are retained by the rollers through a normal setting period without the requirement of a heat retentive core. Finally, the preferred embodiment of the apparatus includes a safety factor in that the water or other liquid used to generate the moistening steam or vapor is heated by the application of microwave energy to the water molecules, thus there is no need for an electrical element to be employed within the roller housing in contact with the water or other liquid. Furthermore, the design of the apparatus is such that when steam is generated, a partial seal or resistance results between the lid and the housing further reducing the risk of spillage of the hot water in the event the unit is dropped.

Accordingly, it is an object of this invention to provide an apparatus and method for curling a person's hair using rollers that are heated and moistened by steam.

It is a further object to provide an apparatus and method whereby lightweight hair rollers may be heated and moistened by steam in a manner so as to retain heat and moisture during a time period in which they are placed in a person's hair.

It is an even further object to provide an apparatus and method whereby heated rollers may be safely and comfortably transported and handled.

It is yet another object to provide an apparatus and method whereby rollers that are heated and moistened have a portion which remains relatively cool to the touch.

It is yet another object to provide an apparatus and method whereby rollers are positioned in a housing in such a manner that the portion which remains cooler is maintained apart from a main heating chamber in which the roller body is suspended.

It is a still further object to provide an apparatus and method whereby hair rollers may be heated and moistened by steam produced within an enclosed chamber by the action of microwave energy.

Further objects and advantages will be evident from the following drawings and description setting forth the best mode of practicing the present invention.

BRIEF DESCRIPTION OF THE DRAWINGS

FIG. 3 is a perspective view of an alternative embodiment of the roller support.

FIG. 4 is a perspective view of a preferred style of hair roller for use with the apparatus.

FIG. 5 is an exploded view illustrating an alternative construction for a hair roller to be used with the apparatus.

FIG. 7 is a partial cutaway side view of a further embodiment of an apparatus of the present invention illustrating a small portable or travel unit.

FIG. 8 is an end view of the embodiment of FIG. 7.

DETAILED DESCRIPTION OF THE INVENTION

Figure 1:
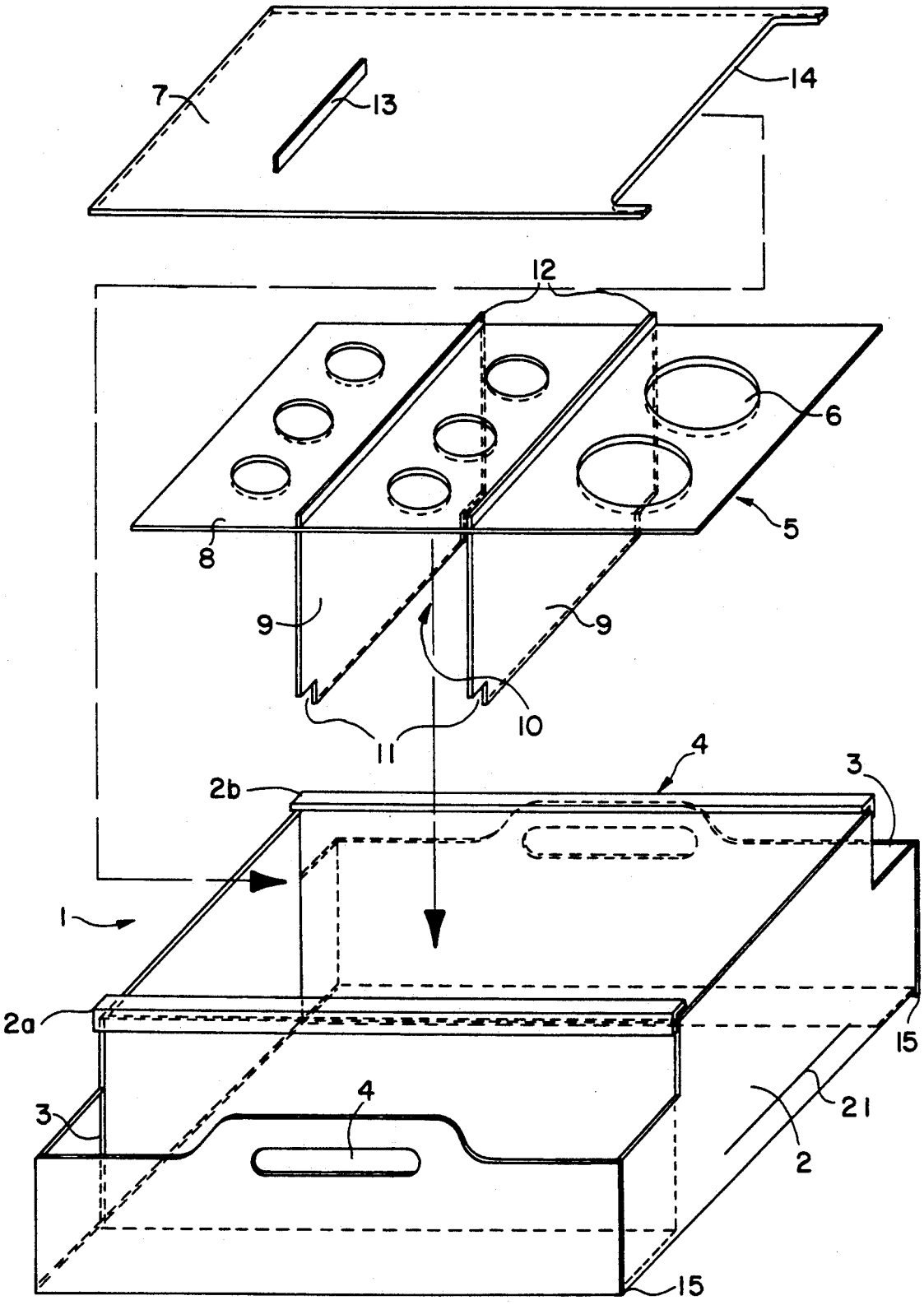
FIG. 1 is an exploded view of one embodiment of the apparatus of the invention illustrating the three primary parts and their relationship.
Figure 2:
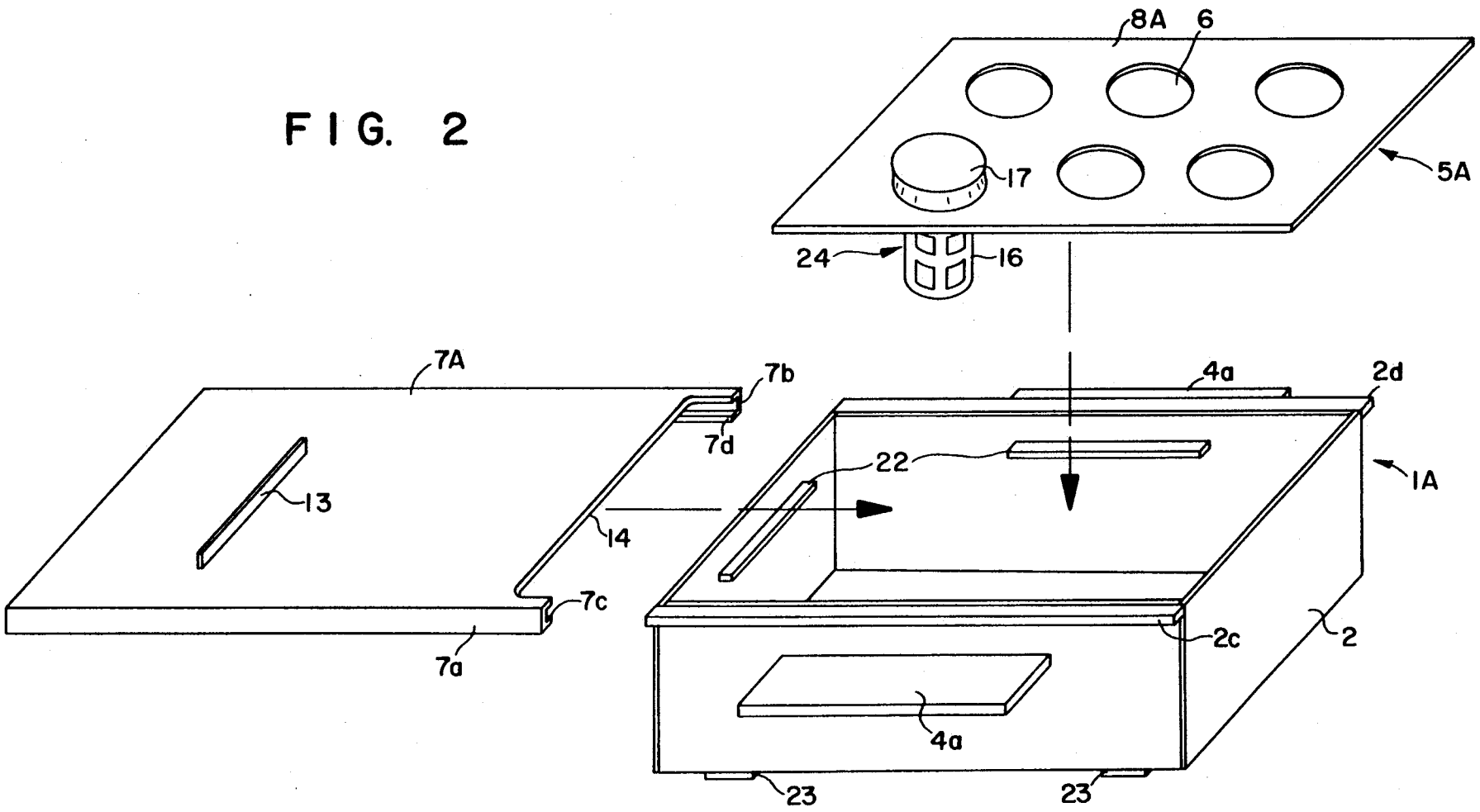
FIG. 2 is an exploded view of the apparatus showing an alternative embodiment for a smaller set of rollers.

As shown in FIG. 1, the apparatus of the invention preferably comprises a housing 1 having a main heating chamber 2 with additional storage chambers 3 along two opposite sides. Within the heating chamber 2 is a roller support means 5 with holes 6 through which hair rollers 24 are introduced into and positioned within the chamber 2. Preferably the support means 5 is removable allowing access to the chamber 2 for cleaning. A lid 7 is slidable relative to the housing 1 over the top of the support means 5 and heating chamber 2, there being means associated with the housing 1 providing a track on either side of the heating chamber 2 for guiding the lid 7 and holding it in place. These means may comprise inverted "L" shaped members 2*a* and 2*b* situated along opposite top edges of chamber 2 such that the "L" extends over and above the top edges a sufficient distance to form tracks within which lid 7 is slidable as shown in FIG. 1. Alternatively, chamber 2 may have longitudinal members 2*c* and 2*d* along opposite edges forming outwardly extending flanges and lid 7A may be provided with a pair of depending skirts 7*a* and 7*b* having inwardly projecting flanges 7*c* and 7*d* forming "C" shaped channels with the underside of lid 7A to slide over members 2*c* and 2*d* as shown in FIG. 2.

Although the device is shown as being rectangular in shape, this is primarily for convenience and any desired shape may be employed. The primary criteria for the overall design is that there be a water tight chamber in which the rollers may be suspended and in which steam may be produced to thereby heat and moisten the rollers and in which such heat and moisture may be retained for a reasonable time to allow users to set their hair.

The preferred support means 5, as shown in FIG. 1, comprises a roller support plate 8, in which are provided the holes 6 for suspension of the hair rollers 24, and vertical divider plates 9. The divider plates 9 support roller plate 8 within chamber 2 at a height sufficient to allow the rollers 24 to hang in the chamber 2 above the level of water therein and form sub chambers 10 for each group of rollers 24. The subchambers 10 help to concentrate the steam on the rollers 24 within any one particular group. The divider plates 9 are preferably attached to and depend from the under side of roller support plate 8 as shown in FIG. 1, but they may be separate from roller support plate 8 being instead located within heating chamber 2 so that roller support plate 8 is a separate piece and is supported thereon. In either case it is preferred that means be provided in the divider plates 9 to allow water within the heating chamber 2 to flow freely between the subchambers 10 and thereby maintain an equal level throughout heating chamber 2. Such flow means may be provided by means of cutouts 11 within the lower corners of each divider plate 9 or the divider plates 9 may be made slightly smaller than the dimensions of chamber 2 so water will flow around them. Furthermore, chamber 2 may be provided with indicia 21 to indicate the maximum water level required. It is important that water not be excessively high in the chamber 2 since the rollers 24 are to be suspended above the water, not immersed therein.

Holes 6 in roller support plate 8 may be of any size or shape to correspond to the particular rollers 24 being used with the device. Furthermore, the holes 6 may be grouped such that rollers 24 of equal size are grouped together in the same or adjacent subchambers 10. For example, in FIG. 1 three subchambers 10 are provided with two adjacent subchambers having three roller suspension holes 6 of substantially equivalent size associated therewith while the third subchamber has two holes 6 of a size corresponding to so-called "jumbo" rollers. Alternatively, the support means 5*c* depicted in FIG. 3 is provided with three sets of holes 6*a*, *b* and *c*, corresponding substantially to large, medium and small roller sizes. It should be noted that the size and disposition of the roller suspension holes 6 is limited only by the size of the unit and the number and size of the particular rollers 24 to be provided therewith, a standard full set of rollers comprising about twenty-four individual rollers of varying sizes.

Furthermore, it is within the scope of this invention to provide multiple support means for each housing wherein the support means are interchangeable and have different configurations for different numbers and combinations of rollers. For example one support means may have holes grouped to provide support for four jumbo rollers, six medium rollers and twelve small rollers, while another is configured for twelve medium and twelve smaller rollers. In this manner the user may have a wider option as to numbers and types of rollers to heat. It is noted that the different possible configurations would be limited only by the varieties of sizes and types of rollers needed to create particular hair styles.

While the divider plates 9 are located beneath the roller support plate 8, whether attached thereto or within the heating chamber 2, the groups of holes 6 are separated on the upper surface of support plate 8 by means of upper divider strips 12. These strips 12 are in line with the divider plates 9 effectively extending the subchambers 10 above the level of the support plate 8. Divider strips 12 also cooperate with the underside of lid 7 to separate the individual subchambers 10 and their rollers 24 until they are ready to be used. In this manner the heat generated within each subchamber 10 and transferred to the rollers 24 therein by the steam is effectively maintained until the lid 7 is slid backward or forward to expose each group of 24 rollers as desired. When the unit is dry the lid 7 slides easily. However after steam is generated within the heating chamber 2, a certain amount will condense on the inner surface of the lid and the slides resulting in a natural resistance to motion so that a slight pressure is required to move the lid 7. For this purpose a knob means or push bar 13 is provided on the upper surface of the lid 7. The natural resistance provided in the lid 7 is also a safety feature since, in the event the apparatus is dropped or shaken, the lid 7 is less likely to be displaced and the hot water in the chamber 2 is less likely to spill. Also in the lid is a venting means which is necessary in microwave heating operations. This venting means may simply be a series of holes, preferably in one end of the lid 7, or, as depicted in FIGS. 1 and 2, a cutout 14 in one end. The cutout 14 is preferred since it provides the necessary venting during microwave heating but allows the individual subchambers 10 to be exposed for removal of rollers 24 without then creating openings in the adjacent subchamber which would allow heat to escape.

An alternative support means 5c is shown in FIG. 3 and comprises the support plate 8c having holes 6 for rollers 24, divider plates 9 and divider strips 12. As previously noted, divider plates 9 help to concentrate the steam generated around the rollers 24 suspended from plate 8c in the sub-chambers 10. The embodiment of FIG. 3 further includes sub-divider plates 9a depending from the under side of plate 8c at locations between the individual holes 6 of a particular group. In this manner, individual sub-chambers 10a and 10b are created for each roller 24, further concentrating the steam production. As with divider plates 9, sub-divider plates 9a are provided with cutouts 11 or similar means to permit water to freely flow between the sub-chambers 10. In addition to sub-divider plates 9a, sub-divider strips 12a may be provided on the upper surface of plate 8 corresponding to the locations of sub-divider plates 9a to sub-divide the roller groupings. These sub-divider strips 12a also help to concentrate and retain heat and moisture.

It is conceivable that the divider plates 9, 9a and divider strips 12, 12a may be eliminated, particularly in the case of small units of ten or fewer rollers. In this instance, support plate 8A will be provided with appropriate holes 6 and would have an integral support means, such as depending legs, or will rest on supports within chamber 2. Such supports within the chamber 2 may be ledges 22 located within the chamber 2 a sufficient distance below the top edge thereof such that, when the plate 8A and rollers 24 are in place, rollers 24 will be suspended above the water level in the chamber 2 but lid 7A will clear the roller heads 17. Such a configuration is shown in FIG. 2.

Side storage chambers 3 flank the heating chamber 2 but are not connected with it and so remain substantially cool except for heat transmitted through their common walls. This partial heating is desirable in that the side chambers 3 provide a storage location for clips 19 used to hold the rollers 24 in a person's hair. Being able to impart a certain amount of heat to these clips 19 is preferable to make them warm but it is not desired to make them as hot as the roller bodies otherwise they would be difficult to handle. The outer walls of the side storage chambers 3 may be provided with handles 4 for easier transporting of the device. Such handles 4 will not become hot because of their lack of proximity to the heating chamber 2 and the fact that the housing is made from a material that is transparent to microwaves. Also supports 15 are provided along the lower edge of the outer walls of the side chambers 3 to keep the heating chamber 2 off of any surface which might be marred by the heat generated therein. In the embodiment of FIG. 1, supports 15 are the lower edges of the outer walls of side chambers 3 which extend below the bottom surface of the housing 1. Alternatively, individual foot supports 23 may be provided on the bottom of the housing 1 as shown in FIG. 2.

In the alternative embodiment of FIG. 2, which illustrates a compact version of the apparatus, the side chambers 3 are omitted and handles 4a are attached directly to the sides of chamber 2. In this embodiment it is preferred that the handle material, in addition to being transparent to microwaves, be a poor conductor of heat so that the apparatus may be easily handled after heating. FIG. 2 also illustrates the relationship of rollers 24 to the rest of the apparatus wherein the roller body 16 extends through holes 6 in plate 8A and is suspended therein by head 17 which has a greater diameter than holes 6.

Figure 6:
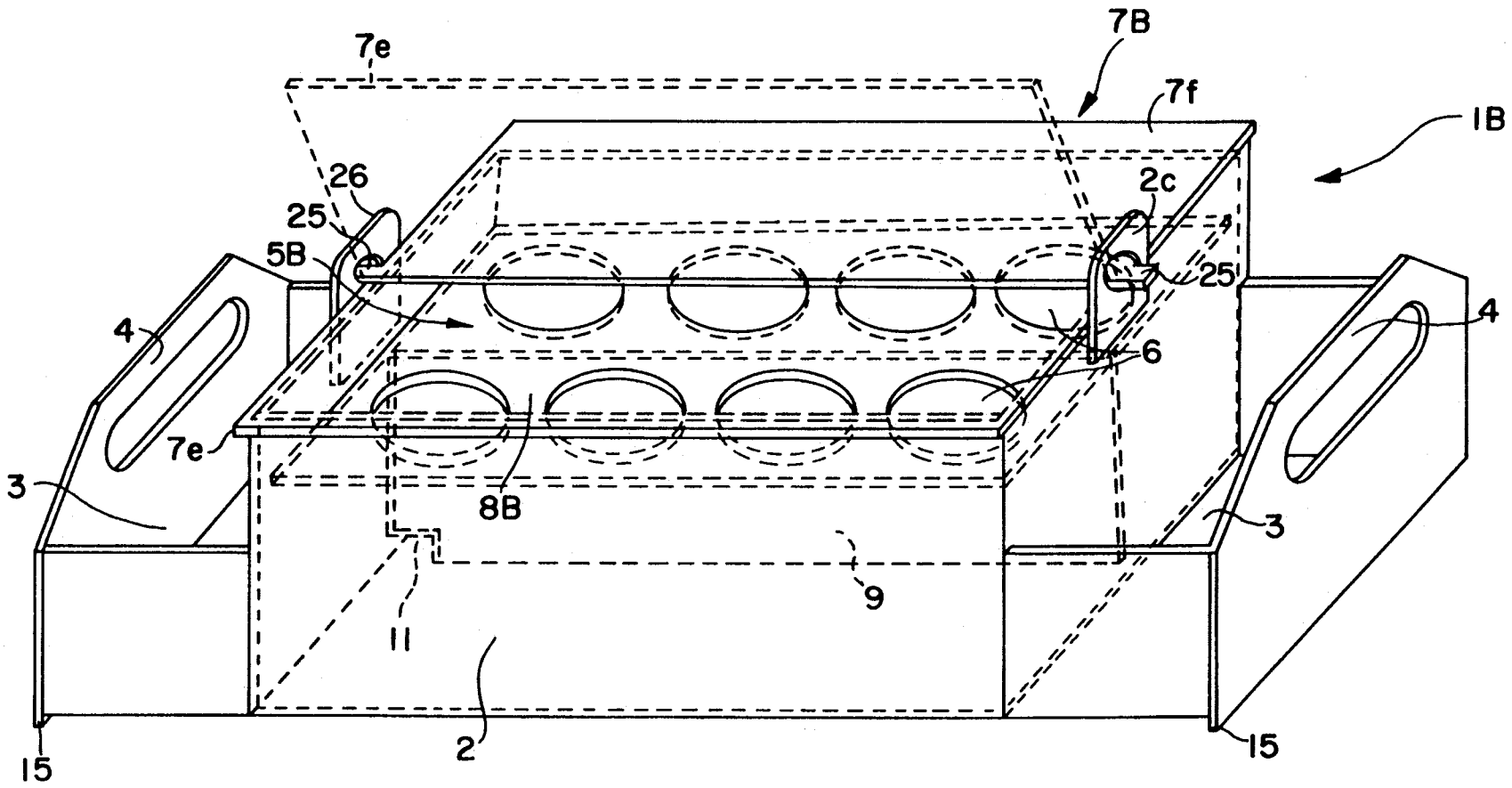
FIG. 6 is a perspective view of a further alternative embodiment of the apparatus of this invention.

A further alternative embodiment, preferably for a compact unit and suitable for use in smaller microwave ovens is shown in FIG. 6. This embodiment is illustrated for eight standard size rollers, however, more or fewer rollers may be used simply by changing the support means 5B.

In this embodiment the main heating chamber 2 is longitudinally elongated and has a narrower width thus being sized for two rows of rollers 24. Storage chambers 3 are located at the ends of main heating chamber 2 and include handles 4 and supports 15. In view of the compact size of this embodiment, roller support means 5B may be simply the plate 8A as shown in FIG. 2. However, preferably support means 5B will include at least one divider plate 9 oriented longitudinally and depending from the support plate 8B along a center line between two rows of holes 6 as shown. As with the other embodiments, divider plate 9 preferably has a cut out 11 to allow free flow of water.

This embodiment also illustrates an alternative hinged lid 7B construction comprising two lid panels 7e, 7f which are attached to housing 1B in a pivotal manner by means of hinge pins 25 which pass through ears 26 at each end of the upper edge of main heating chamber 2. In FIG. 6, lid panel 7e, is shown in phantom in the open position. Ears 26 may be molded as an integral part of the end walls of main heating chamber 2 or they may be separate pieces affixed thereto. Likewise, hinge pins 25 may be integral parts of lid panels 7e, 7f, or may be separately attached. Preferably there will be a space between lid panels 7e and 7f when closed to serve as a vent. Lid panels 7e and 7f may be of a width sufficient to overlap the edges of the main heating chamber walls for ease of opening or a handle means (not shown) may be provided on each panel 7e and 7f. Since each panel 7e or 7f covers only one row of rollers 24, opening one lid panel at a time to access one row of rollers 24 at a time will allow the steam and heat to be maintained around the other row.

The primary embodiments of the apparatus of this invention have been designed for use in home microwave ovens, both full size and compact. The microwave energy generated by the oven is used to heat the water or other liquid used to boiling to thereby generate steam which circulates within the heating chamber. Since the roller bodies 16 are suspended within the heating chamber from above and do not contact the sides or bottom of the chamber, the steam and associated heat is free to circulate completely, around, over and through the structure of the roller bodies 16 while the heads 17 remain relatively cool to the touch. In this manner the circulating steam completely envelopes the roller bodies 16 providing more even and complete heating and moisturization by the condensing steam.

The use of a microwave oven is preferred for safety and convenience since it eliminates the close proximity of electricity and water which is found in the prior art apparatus. However, the concept of complete heating and moisturization of a hair roller body while maintaining a cooler head or handle portion may also be applied to an apparatus employing an electric heating element for steam generation within a closed chamber. The above described preferred apparatus may be modified to include an electric heating element within heating chamber 2 to directly heat the water therein for steam production. Such a heating element may be that as used in the prior art and will preferably include a low water cut off switch, a thermostat preferably coupled with an on-off switch and such other safety devices as may be required by any applicable laws or guidelines.

FIGS. 7 and 8 illustrate an embodiment of a smaller portable or travel unit employing the concept of the present invention wherein the steam is generated by an electrical heating unit. In this embodiment the housing 1C is divided into an upper heating chamber 2 and a lower circuitry chamber 27. Within this lower chamber 27 is disposed thermostat and switch means 28, heating element 29 and any other safety circuitry or devices required. As shown in FIG. 7, heating element 29 may be a heating block supported by legs 30 out of contact with the bottom and sides of housing 1C and forming a shelf on which a water tray 31 sits. In this embodiment, water tray 31 is preferably made of metal to transfer heat from heating element 29 to water within the tray 31. A water sealing means 36 is provided around the tray 31 to prevent spillage onto heating element 29.

Alternatively, heating element 29 may be an immersion type inserted into tray 31 or constructed as an integral part of tray 31 and including a low water cut-off means 37. In such an embodiment, water tray 31 may be constructed from any material which would withstand the heat generated and may even be made of a high heat resistant polymer. In either case an electric power cord 33 exits from lower chamber 27 through a strain relief 34 and terminates in an electrical plug means 35.

Housing 1C is preferably molded as a single unit with a bottom and four connected upstanding sides and is open at the top. Water tray 31 and heating element 29 are recessed within housing 1 a sufficient distance from the open top edge of housing 1C to permit rollers 24 to be suspended above tray 31. In the illustrated embodiment, suspension of the rollers 24 is provided by a lid 32 comprising a planar portion **32*a* surrounded by a depending skirt 32*b*. Lid 32 is sized to fit over the open end of housing 1C with skirt 32*b* telescoping over the upper edges of housing 1C walls as shown. The fit should be reasonably snug to prevent undue escape of steam or heat as well as inadvertent spillage in the event of a tipping of the unit. Within the planar portion 32*a* of lid 32*b* are provided holes 6 through which rollers 24 are inserted. As with the previous embodiments these holes 6 are of a size to permit passage of the roller bodies 16 but not the roller heads 17. In this manner the rollers 24 are suspended within heating chamber 2 above water tray 31 so that the steam generated therein can completely envelope the roller bodies 16**.

Whereas the unit illustrated in FIGS. 7 and 8 is a portable or travel type unit and is shown as being provided with two rows of five rollers each, it is noted that this embodiment may be provided with different numbers and combinations of rollers as in the previous embodiments merely by changing the lid 32 and, when desired, the overall dimensions of the unit. Furthermore, when unplugged and not in use, the upper heating chamber 2 provides storage for the rollers. Optionally, the unit may also be provided with means to permit its use on two or more different line voltages.

The preferred form of the rollers 24 to be used with this device are shown in FIGS. 4 and 5 and comprises essentially a roller body 16 having a head 17 on one end. The head 17 has a diameter substantially larger than the roller body 16 to provide both a handle means for grasping the roller 24 and a means for suspending the roller 24 within the holes 6 in the roller support plate 8. The head 17 has a greater diameter than the corresponding holes 6 thereby preventing the rollers 24 from falling through the plate 8 into the heating chamber 2. Furthermore, because the head 17 remains above the heating chamber 2, separated therefrom by the support plate 8, it remains relatively cool and safe to handle. The construction of the rollers 24 may be as that depicted in FIG. 4 comprising the roller body 16 with the head 17 attached directly thereto, the entire roller 24 being molded as a single unit, or it may be as shown in FIG. 5 wherein the head 17 is attached to a roller support cylinder 18 and the roller body 16 is slid onto the cylinder 18. In either case, it is preferred that the roller body 16, or the support cylinder 18 have sufficient thickness to provide a heat retention mass which, because of the materials used, will be lightweight. Because of the design and operation of the apparatus, an additional material in the roller body as a heat retention mass such as an oil or metal core which would add weight is not necessary. Since the roller bodies 16 remain in the heating chamber until actual use, they are continuously warmed by the heat retained therein. Furthermore, by using moist heat directly applied to the hair by the roller bodies 16, the time required to achieve a set is reduced, thereby removing the necessity for an excessively heavy heat retention core in the roller bodies 16. An elongated roller clip 19 having a semicircular cross-section fits over the roller body 16 after placement in the hair to hold the roller in place. The head 17 also serves to hold the heated roller away from the scalp thereby preventing burning or discomfort thereto. The edge of the head 17 is preferably provided with a circumferential groove 20 to facilitate grasping by the user. As with most hair rollers, hair grasping means are present on the outer surface of the roller body 16 and on the inner surface of the clip 19. Such means serve to hold and transmit both moisture and heat from the roller body to the hair. Such hair grasping means may comprise projecting teeth, **16*a* as shown as FIG. 4, preferably molded of the same material as the roller body 16**, flocking, hook and pile material, bristles or other suitable means. Where such hair grasping means are teeth they also serve to help hold the heated roller away from the scalp to prevent burning or discomfort.

In the preferred embodiments the materials from which the apparatus and the rollers are made are preferably transparent to microwaves and so are not directly heated when the apparatus is exposed to microwave energy. Such materials include polycarbonate, or other microwave transparent polymers that are resistant to temperatures above 212 degrees Fahrenheit. In the electrically heated embodiments, microwave transparency is not important, but, the material must still be resistant to high temperatures. Delrin is a popular material for hair rollers that is light weight and is adequate for molding the roller bodies 16 and clips 19. It is conceivable that, in the construction of FIG. 5, roller body 16 could be covered with a strip of hook and pile material wrapped therearound or such material or flocking could be applied directly to the surface of the roller body 16 as shown in FIG. 5 or to cylinder 18 to form a roller 24 suitable for use with the apparatus. In that case the hook and pile or flocking material and any adhesives used must also be resistant to temperatures above 212 degrees Fahrenheit.

The three primary parts of the apparatus may be molded from an appropriate material or constructed from individual pieces cut from sheet stock. Preferably, roller support means 5 is a single sub-assembly with the divider plates 9, 9*a* and strips 12, 12*a* being integrally molded with or otherwise secured to support plate 8. However, support means 5 may be two parts comprising the network of divider plates 9 and sub-plates 9*a* as a separate assembly that is removably positioned within the heating chamber 2 and a separate support plate 8 with divider strips 12 and sub-strips 12*a* that is then placed over the divider plate sub-assembly. In such a construction, the support plate 8 will be placed over the divider plates 9 and 9*a* so that the plates and the divider strips 12 and 12*a* line up.

Although not a requirement, it is preferred that the material from which the housing 1, support means 5 and lid 7 are made be optically transparent as well as microwave transparent.

In operation, approximately one to one and a half cups of water or other suitable liquid is placed in the heating chamber 2 and the support means 5 inserted therein. This volume of water will of course vary with the size of the unit and the number of rollers to be heated; however, sufficient liquid must be used to provide enough heat in the chamber to keep the rollers hot until they are used. In the case of a full set of twenty-four rollers it has been found that using one and a half cups of water provides enough steam to heat the full set in about 6 to 8 minutes in a 700–800 watt oven and sufficient retained heat to keep the rollers hot until they are all wound in the user's hair. For smaller sets of rollers, smaller amounts of water may be used so long as there is enough to provide both initial steam heat and sufficient retained heat to keep the rollers hot until the user has them all in place.

The rollers are then inserted into their respective holes in the support plate 8, as shown in FIG. 2, the lid 7 is closed and the entire apparatus placed in a microwave oven and exposed to microwave energy for about seven minutes or for a sufficient time to cause the water to boil. Different wattage ovens require different times to boil equivalent amounts of water. The steam generated by boiling the water transfers heat to the rollers 24 suspended in the heating chamber 2 and partially condenses thereon to moisten the rollers 24. The rollers 24 retain heat and moisture for the normal setting period, about 7 to 12 minutes, because of their suspension over the hot water and from heat radiating off the chamber walls.

When the rollers 24 are ready to be used the lid 7 is opened to expose the first group of rollers. Since the heads 17 of the rollers 24 are outside of the main heating chamber 2, they remain relatively cool and are easily handled without discomfort while the roller bodies 16 remain within the heating chamber 2 until actually withdrawn and are kept warm and moist by the heat and steam retained therein. Exposure of each group of rollers 24 is made as needed, generally beginning at the vented end of the lid 7 in the embodiments shown in FIGS. 1 and 2 since the cutout 14 allows excess steam to escape. In units having hinged lid panels, as in FIG. 6, the gap between the panels provides the necessary venting and the rollers are exposed by opening one panel at a time. As each group of rollers 24 is used, the lid 7 is opened further, exposing each group as needed and in the first embodiment, strips 12 on the top of roller suspension plate 8 cooperate with the underside of the lid 7 to help close off groups until the lid 7 is slid back to expose them.

The first rollers used will be the hottest and should generally be wound where the most curl is desired. If jumbo rollers are included in a set, they should be located at one end of the roller suspension plate 8 so that, if preferred, they may be used first. It is important that the rollers go directly from the housing 2 into the hair; accordingly, the hair to be wound into each curl should be sectioned off before the rollers are removed from the housing. In this manner each roller will be wound into the hair while it is at its hottest, the heat and moisture serving to quickly plasticize the hair and thereby form the curl. Because the rollers provide moisture, the hair should be dry before their use.

In the embodiment shown in FIGS. 7 and 8, water is placed in tray 31, the lid 32 is applied to the unit and rollers 24 are inserted into holes 6 in the lid 32. The unit is then plugged into an appropriate electrical outlet and, if a separate on-off switch is provided, turned on. After allowing time for steam generation and heating of the roller bodies 16, the unit may be turned off and/or unplugged and the rollers 24 withdrawn one at a time and applied to the hair. Remaining rollers will retain heat and moisture until withdrawn for use.

Since the units use boiling water to provide both the heat and moisture to the rollers, no impurities will be imparted to the hair, the water being substantially distilled or sterilized. Additionally, the boiling water serves to sterilize the entire system of rollers and housing each time it is used thereby reducing the possibility of the retention or transfer of any infectious organisms from the rollers. Furthermore, if the setting process is interrupted such that the system cools down it is easily reheated by returning it to the microwave oven or, in the electrical form, turning it on for a few minutes.

After the rollers have been in place in the hair a sufficient time, they are removed on a first-in, first-out basis. While in the hair the rollers will serve to impart heat and moisture to the hair, causing it to plasticize while wound around the roller, then the heat will dry the hair thus setting the curl. Upon removal of the rollers, the user should brush her fingers lightly through the curls to detect any residual moisture before combing or brushing the hair since remaining moisture could ruin the curl in that area.

The rollers need remain in the user's hair only as long as necessary to produce the desired curl. However, leaving them in for a longer period is not a problem in view of their significantly lighter weight when compared with the prior art electrically heated rollers.

It is also envisioned that the apparatus may be used to treat hair with various substances, such as conditioners, hot oil and the like, which may be added to the water in chamber 2 before heating. In this manner, the treatment substances will boil with the water and be deposited on the rollers with the condensing steam. Winding the thus moistened rollers in one's hair will serve to apply the treatment substances thereto while the hair is being curled.

Suspending the rollers in a heating chamber in the manner provided by the apparatus of this invention has three advantages not realized by the prior art. First, a portion of the roller, the head, is provided which remains significantly cooler to the touch than the rest of the roller, thus rendering the rollers easier and safer to handle when heated. Second, the entire interior and exterior of the roller bodies is heated and moisturized since no portion of the roller body is in contact with any part of the housing. Third, since each roller is individually suspended within the heating chamber they remain within the enveloping steam and heat until individually withdrawn for use thereby retaining optimum heat and moisture capacity.

The foregoing sets forth the preferred apparatus and method of use. Other alternatives, modifications and variations will be apparent to one skilled in the art in light of the foregoing description and it is intended to embrace all such alternatives, modifications and variations as fall within the spirit and scope of the appended claims.

What is claimed is:

1. A hair curling apparatus including a plurality of hair rollers in combination with means for heating and moistening said rollers, said heating and moistening means comprising a housing having a bottom and upstanding side walls forming an open top chamber, a removable and changeable hair roller support means in combination with said housing defining a steam chamber within said housing between said bottom and said hair roller support means, and bounded by said upstanding side walls, and having means to vertically suspend said hair rollers therefrom within said steam chamber said plurality of hair rollers being vertically suspended within said steam chamber by said hair roller support means and an openable lid covering said chamber, wherein said hair roller support means comprises a horizontal plate having an upper surface and a lower surface and a plurality of holes therein sized to allow the passage of said rollers through said plate and means to support said plate above the bottom of said housing a distance sufficient to permit said rollers to be vertically suspended from said plate above the bottom of said housing and within said steam chamber, each of said rollers having means cooperating with said plate to effect their suspension whereby a portion of each roller is maintained above said plate and outside of said steam chamber, and wherein said steam chamber is capable of containing a quantity of liquid capable of being heated to boiling thereby generating steam within said steam chamber which condenses on said rollers to heat and moisten said rollers, whereby said housing, said hair roller support means and said lid cooperate to retain heat and moisture around said suspended rollers until their removal from said apparatus.

2. The apparatus of claim 1 wherein said steam chamber is further defined by the bottom of said housing and the lower surface of said plate and wherein said rollers each comprise a substantially cylindrical body of a diameter allowing passage through said holes and a circular head at one end of said body having a diameter larger than said body and said holes, said head comprising said means cooperating with said plate whereby the cylindrical bodies of said rollers are suspended from said plate within said steam chamber for heating by said steam and whereby said circular heads are seated on the upper surface of said plate and are maintained outside of said steam chamber by said plate whereby they are not heated to the degree of said cylindrical bodies and remain relatively cool to the touch whereby said rollers may be safely removed from said apparatus following heating.

3. The apparatus of claim 2 wherein said rollers are of different diameters and said plate is provided with holes corresponding to said roller diameters.

4. The apparatus of claim 2 wherein said rollers comprise said body and said head, said body having hair engaging means thereon and said head having an annular concavity about its perimeter.

5. The apparatus of claim 2 wherein said housing, said hair roller support means and said lid are constructed from materials transparent to microwave energy and said quantity of liquid is capable of being heated to boiling by microwave energy entering said housing.

6. The apparatus of claim 1 wherein said means to support said plate comprises divider plates depending vertically from said horizontal plate and arranged relative thereto to provide division for at least one roller suspended within said steam chamber, said divider plates forming sub-chambers within said steam chamber and having means to permit free flow of liquid between said sub-chambers, said sub-chambers comprising means to concentrate said steam about said rollers.

7. The apparatus of claim 6 wherein said rollers are of differing diameters, said horizontal plate is provided with holes corresponding to said diameters and said holes and rollers are grouped according to said diameters.

8. The apparatus of claim 7 wherein said hair roller support means is selectable from a plurality of interchangeable hair roller support means each having a different configuration of said holes in said horizontal plate.

9. The apparatus of claim 1 wherein said means to support said plate comprises means within said chamber upon which said plate is placed.

10. The apparatus of claim 1 further comprising means within said housing and forming the bottom of said steam chamber for containing said quantity of liquid and means within said housing for heating said liquid to boiling to generate a quantity of steam within said chamber; wherein said rollers each comprise a cylindrical roller body having on one end thereof a head comprising a circular flange of a diameter greater than that of said body and said holes in said plate thereby preventing passage of said heads through said holes whereby the rollers are supported by the engagement of the heads thereof with the plate member outside of said steam chamber and the roller bodies are suspended within said steam chamber.

11. The apparatus of claim 10 wherein said means for heating said liquid comprises an electrically powered heating element controlled by a thermostatic control means responsive to the temperature of the chamber and a low water cut-off means responsive to the liquid level in the chamber.

12. The apparatus of claim 10 wherein said chamber has an open top end to form said access opening and said removable and changeable hair roller support means comprises a horizontally planar plate of a size and shape corresponding to that of said open top end of said chamber and a depending skirt continuous about the perimeter of said plate, said support means having dimensions to fit over said open top end of said chamber, said skirt telescoping over the outer surfaces of said upstanding side walls, whereby said support means forms a lid for said chamber.

13. The apparatus of claim 10 wherein said roller body further comprises hair grasping means disposed about the outer surface of said body.

14. A hair curling apparatus including a plurality of hair rollers in combination with means for heating and moistening said rollers, said heating and moistening means comprising:

a) a housing having an open top, a bottom and upstanding side walls, b) a chamber within said housing capable of containing a quantity of liquid capable of being heated by microwave energy, c) a removable hair roller support means in said chamber in combination with said housing forming a steam chamber between said hair roller support means and the bottom of said housing and comprising means to vertically suspend said plurality of hair rollers within said steam chamber above the level of the liquid, and d) a lid covering said open housing top and openable with respect to said housing chamber, said lid having vent means therein and capable of being opened in a manner to expose said hair rollers in a sequential manner;

wherein said hair roller support means comprises a horizontal plate positioned above the bottom of said housing and having a plurality of holes through which said hair rollers are inserted into said steam chamber, said rollers having an enlarged end the diameter of which is greater than that of said holes and which does not pass through whereby said rollers are vertically suspended from said plate within said steam chamber and wherein said apparatus and said rollers are constructed from materials transparent to microwave energy.

15. The apparatus of claim 14 further comprising means depending from said plate separating said holes into groups and forming sub-chambers within said steam chamber and means on the upper surface of said plate in locations corresponding to said depending means whereby said sub-chambers are continued above said horizontal plate, said upper means cooperating with said lid to maintain closure of successive sub-chambers as preceding sub-chambers are exposed whereby heat and moisture are retained in said sub-chambers until exposed by opening said lid.

16. The apparatus of claim 14 further comprising at least one side storage chamber flanking said liquid containing chamber and separated therefrom by a common wall.

17. A method of heating and moistening a plurality of hair rollers preparatory to use comprising vertically suspending a plurality of rollers in an open top chamber of a microwave transparent housing, introducing a quantity of water into the chamber to a level below the rollers, covering the open top of the chamber with a removable vented lid, exposing the housing and contents to microwave energy for a time sufficient to cause said water to boil thereby generating steam within said chamber, whereby said steam envelopes said rollers and transfers heat and moisture to said rollers; the method further comprising providing a horizontal support plate in combination with said housing whereby a steam chamber is provided within said open top chamber below said support plate, said horizontal support plate having a plurality of holes therein sized to permit passage of said hair rollers, and utilizing said horizontal support plate to vertically suspend said rollers within said steam chamber; the method further comprising providing said rollers with means at one end cooperating with said support horizontal support plate to suspend said rollers such that said one end of each of said rollers is maintained outside of said steam chamber above said horizontal support plate whereby said one end has less contact with said steam and remains cool to the touch.

18. The method of claim 19 further comprising adding hair treatment substances to said water prior to exposure to microwave energy whereby said substances will be heated and applied to said rollers by said steam.

19. The method of claim 17 further comprising providing said plurality of rollers in different sizes and grouping said rollers within said chamber according to size.

* * * * *

UNITED STATES PATENT AND TRADEMARK OFFICE

CERTIFICATE OF CORRECTION

PATENT NO. : 5,286,949

DATED : February 15, 1994

INVENTOR(S) : Rosemary Simons

It is certified that error appears in the above-identified patent and that said Letters Patent is hereby corrected as shown below:

Column 14:

Claim 15, line 2, between "said" and "plate", insert --horizontal--

Claim 18, line 42, delete "19", insert --17--

Signed and Sealed this

Fourteenth Day of June, 1994

*Attest:*

Bruce Lehman

BRUCE LEHMAN

*Attesting Officer*

*Commissioner of Patents and Trademarks*